US005941204A

United States Patent [19]

Randolph

[11] Patent Number: 5,941,204

[45] Date of Patent: Aug. 24, 1999

[54] HEATING AND PRESSURIZATION SYSTEM FOR LIQUID-COOLED ENGINES

[76] Inventor: Ronald E. Randolph, 2190 San Luis Rd., Walnut Creek, Calif. 94596

[21] Appl. No.: 09/098,882

[22] Filed: Jun. 17, 1998

Related U.S. Application Data

[63] Continuation-in-part of application No. 08/794,844, Feb. 4, 1997, abandoned.

[51] Int. Cl.[6] ..... F02N 17/06

[52] U.S. Cl. ..... 123/142.5 E; 237/12.3 B; 237/12.7; 219/208

[58] Field of Search ..... 123/142.5 E; 237/12.7, 237/12.3 B; 126/367; 219/208

[56] References Cited

U.S. PATENT DOCUMENTS

| | | | |
|---|---|---|---|
| 4,208,570 | 6/1980 | Rynard | 219/208 |
| 4,249,491 | 2/1981 | Stein | 123/142.5 R |
| 4,503,812 | 3/1985 | Eberhardt | 123/2 |
| 5,048,753 | 9/1991 | Kellie | 237/12.3 C |
| 5,408,960 | 4/1995 | Woytowich | 123/142.5 E |

FOREIGN PATENT DOCUMENTS

| | | | |
|---|---|---|---|
| 35 30 532 | 3/1987 | Germany | 219/208 |
| 165787 | 6/1921 | United Kingdom | 123/142.5 E |

*Primary Examiner*—Willis R. Wolfe
*Assistant Examiner*—Brian J. Hairston
*Attorney, Agent, or Firm*—Finley & Berg, LLP

[57] ABSTRACT

A heating and pressurization system for a liquid-cooled engine having a cooling system is provided. The heating and pressurization system includes a coolant circulation and pressurization system comprising a coolant tank, a coolant pump receiving coolant from the coolant tank through a manifold, a coolant outlet conduit, and a coolant inlet conduit. The coolant outlet conduit and coolant inlet conduit each have an end which has a double dry break quick disconnect coupling which is detachably fixable to the cooling system of the engine and to another double dry break quick disconnect coupling attached to the coolant tank though an access passage. An immersion heater is incorporated into the coolant circulation and pressurization system which is operable to heat coolant circulating therein. The coolant pump is operable to circulate coolant at a constant pressure through the coolant circulation and pressurization system and the cooling system of the engine when the coolant outlet conduit and the coolant inlet conduit are detachably fixed to the cooling system of the engine.

12 Claims, 5 Drawing Sheets

HEATING AND PRESSURIZATION SYSTEM FOR LIQUID-COOLED ENGINES

CROSS-REFERENCES TO RELATED APPLICATIONS

This application is a continuation-in-part of application Ser. No. 08/794,844, filed Feb. 4, 1997, now abandoned.

FIELD OF THE INVENTION

This invention generally relates to heating devices used to preheat and pressurize the cooling system of liquid-cooled engines.

BACKGROUND OF THE INVENTION

There are a variety of situations in which an internal combustion engine will not function properly without preheating. For example, in extremely cold weather machinery employing engines can become inoperative when the engine is too cold to start.

The need for engine preheating is particularly acute in the fields of auto and boat racing. The clearances between components of an engine are greater when the engine is operated cold than when it is operated at normal operating temperature. The clearances must be sufficient to prevent their chafing against each other during cold starting and when operated at temperatures below operating temperature. Racing engines develop maximum power when the clearances are at their minimum and the engine coolant temperature is in the 190 to 220 degrees Fahrenheit range. Because the metal components of a racing engine expand significantly as the engine heats from its cold state to operating temperature, the clearances between its components significantly widen when the engine cools. Therefore, it is necessary to provide overly large clearances (especially piston-to-cylinder clearances and piston ring end clearance) in cold engines to prevent scuffing or galling of the components during the period before the cold engine reaches normal operating temperature. These overly large clearances negatively impact racing performance.

Excessive clearances between components existing while the engine is cold can also cause leakage damage when the engine is operated while cold. For example, if the clearances between a piston and cylinder in a cold engine are too large, oil can pass between them and contaminate the combustion chamber and piston top. This forms carbon deposits which can cause power robbing detonation and compression gas blow-by during engine operation.

Further, because the engine's components expand unequally as the engine is heated naturally by its own combustion, the engine may sustain damage when started cold. The engine's combustion does not transfer heat equally to each engine component. As a result, some engine components undergo more thermal expansion than others because more heat is applied to them. These problems may be exacerbated by differences in the thermal rates of expansion of the engine components, which typically are made of different materials. Because the engine components expand at different rates, they may abrade or break each other where they are forced into undesired contact. For example, when an engine is running, its combustion heat (usually about 1,500 degrees Fahrenheit) is applied directly to the top of each piston and the top piston ring. If the piston top expands more quickly than does the cylinder in which the piston is housed, the piston will scuff against the cylinder. If the piston ring expands faster than the cylinder, the ring end gap will close, resulting in a broken ring or broken piston ring land.

The need for engine preheating is particularly acute in alcohol-fueled racing engines. The cooling effect of the alcohol fuel drawn into the engine during operation prevents the engine from gaining heat as quickly as would a gasoline-powered engine. This increases the time during which the engine operates at less than full operating temperature which aggravates the problems described above.

Components used in race engines are subjected to extremely high pressures due to high spring pressures and high combustion pressures, making proper lubrication of the components essential. By preheating the engine to heat the oil in the oil pan as well as the engine components, the warm oil will flow more easily through oil passages in the engine to the warm metal surfaces of the components and will have better adhesion to the warmed surfaces of the components. This provides increased lubrication ability.

Consequently, racing engines should be brought as close as possible to operating temperature prior to being operated at high rpm and full power. While many engine heaters have been developed, many are unfeasible for use with racing engines. Engine heaters which are permanently mounted on the engine add undesirable weight to the vehicle and incorporate equipment into the vehicle which can hamper the efficiency of the vehicle's cooling system or cause breakdown of the cooling system if the equipment fails. Non-portable engine heaters typically cannot be brought to a racing site. Portable butane-fired heaters or the like which blow hot air onto the exterior of an engine do not evenly heat the engine's coolant and other internal and external components. Further, those heaters which use a water tube type heat exchanger to transfer heat from hot gasses produced from burning butane to the coolant do not adequately control temperature, and cause coolant in the tubes to boil as the result of applying high temperature gases to the outer surface of the metal tubes, thereby introducing air into the coolant system. Air in the coolant system prevents the coolant from carrying off heat, decreasing engine power and potentially causing catastrophic engine failure. These heaters are also generally unadvisable and often prohibited for use in racing areas because they produce an open flame as their method of heating.

Accordingly, it is a primary object of the present invention to provide a heating and pressurization system for liquid-cooled internal combustion engines which can produce or sustain operating temperature in the engine by evenly heating the engine's components through circulation of heated coolant through the engine's coolant system and doing this in a reasonable amount of time.

Another object of the present invention is to provide a portable heating and pressurization system which can be used to produce or sustain operating temperature in a racing vehicle's engine between individual races at a race site.

A further object of the present invention is to use liquid pressure from the pump to pressurize the cooling system of an engine being preheated to increase the boiling point of the coolant in the cooling system.

Yet another object of the present invention is to provide a portable heating and pressurization system for a liquid-cooled internal combustion engine which can be easily connected to and disconnected from the engine without introducing air into the engine's coolant system.

A still further object of the present invention is to provide a heating and pressurization system which can be applied to an internal combustion engine during its machining operations so that the clearances between its components can be measured and machined precisely for minimum clearances to provide optimal functioning at operating temperature.

Other objects and advantages of the present invention will become apparent when the heating and pressurization system of the present invention is considered in conjunction with the accompanying drawings, specification, and claims.

SUMMARY OF THE INVENTION

A heating and pressurization system for a liquid-cooled engine having a cooling system is provided. The heating and pressurization system includes a coolant circulation circuit comprising a coolant tank, a coolant pump receiving coolant from the coolant tank through a manifold, a coolant outlet conduit, and a coolant inlet conduit. The coolant outlet conduit has two ends, one of which is attached to the coolant pump and the other of which has a first double dry break quick disconnect coupling which is detachably fixable to an inlet of the cooling system of the engine. The coolant inlet conduit has two ends, one of which is attached to the coolant tank and the other of which has a second double dry break quick disconnect coupling which is detachably fixable to an outlet of the cooling system of the engine. An immersion heater is incorporated into the coolant circulation circuit which is operable to heat coolant circulating therein. A third double dry break quick disconnect coupling connected to the coolant tank by an access passage is provided to which the first and second double dry break quick disconnect couplings can be detachably fixed.

The coolant pump is operable to circulate coolant at a constant pressure through the coolant circulation circuit and the cooling system of the engine when the coolant outlet conduit is detachably fixed to the inlet of the cooling system of the engine and the coolant inlet conduit is detachably fixed to the outlet of the cooling system of the engine.

DESCRIPTION OF THE PREFERRED EMBODIMENT

Figure 1:
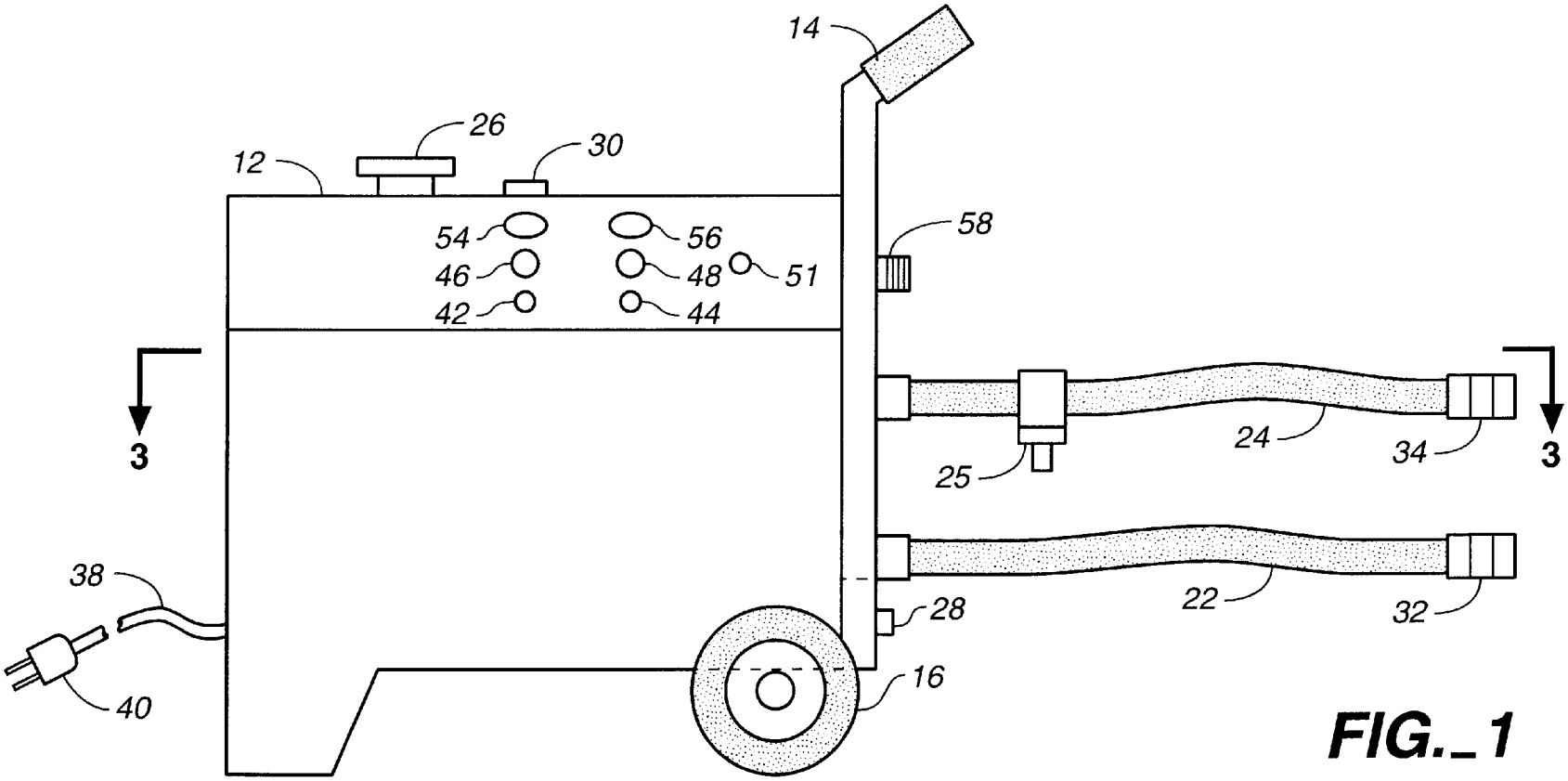
FIG. 1 is a front plan view of the inventive heating and pressurization system.
Figure 2:
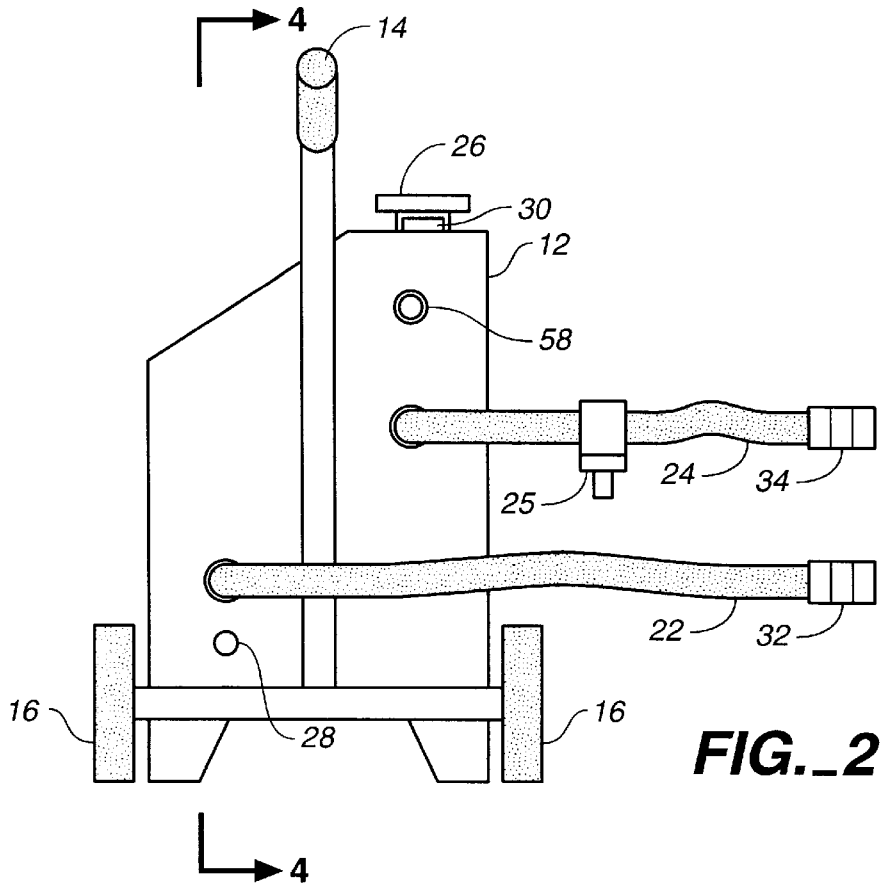
FIG. 2 is a side plan view of the inventive heating and pressurization system of FIG. 1.

Referring to FIGS. 1 and 2, a preferred embodiment of the inventive heating and pressurization system 10 for liquid-cooled engines is shown. Heating and pressurization system 10 is housed within a cabinet 12, preferably formed of a durable material such as a metal. As the inventive heating and pressurization system 10 is preferably easily portable, a handle 14 and wheels 16 may be fitted to the cabinet 12 to increase its maneuverability.

Figure 3:
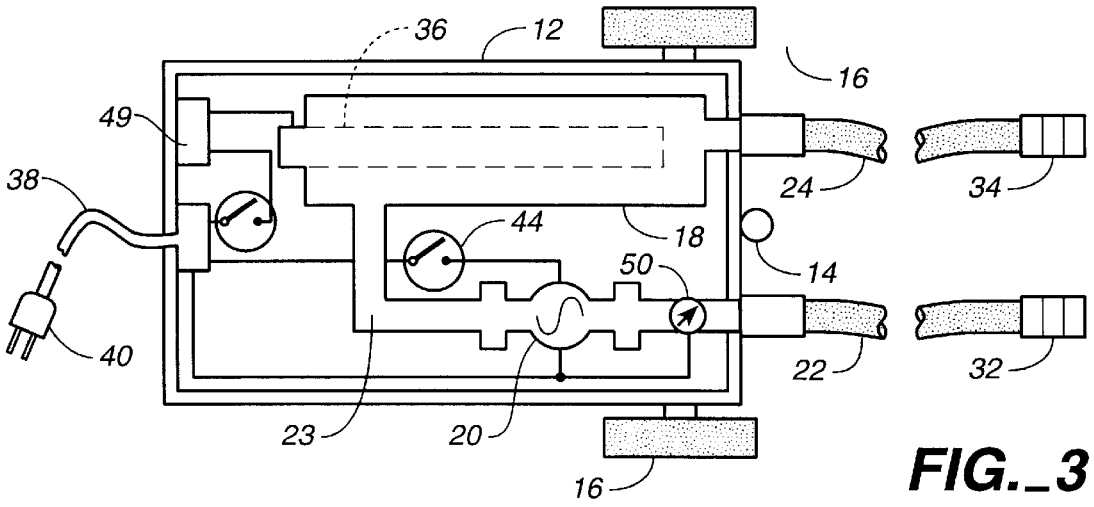
FIG. 3 is a top cross-sectional view of the inventive heating and pressurization system of FIG. 1 taken at section line 3—3.
Figure 4:
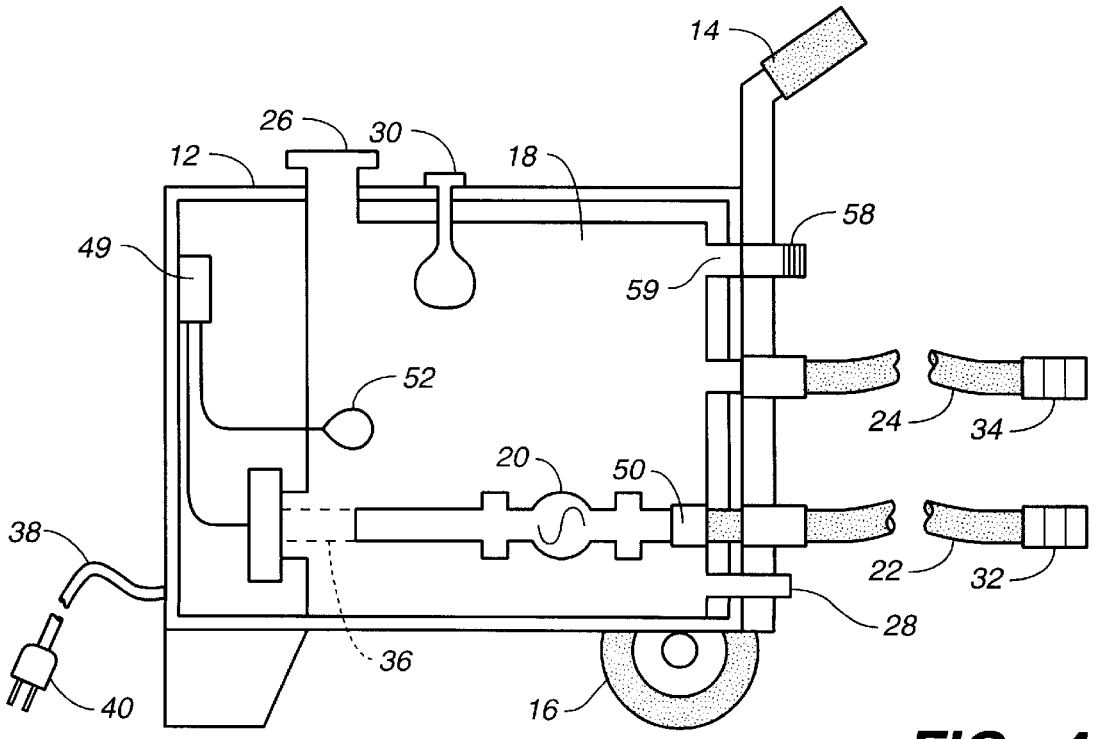
FIG. 4 is a side cross-sectional view of the inventive heating and pressurization system of FIG. 2 taken at section line 4—4.

Referring to FIGS. 3 and 4, cabinet 12 houses a coolant circulation circuit comprising a coolant tank 18, a coolant pump 20, a coolant outlet conduit 22, and a coolant inlet conduit 24. Coolant tank 18 stores a reservoir of coolant of the type used in the cooling system of the engine to be preheated. In the preferred embodiment, tank inlet 26 and tank outlet 28 allow the user to fill or drain coolant from coolant tank 18. Both tank inlet 26 and tank outlet 28 are capped when not in use. Coolant level gauge 30 indicates the level of coolant present in coolant tank 18.

Coolant tank 18 should vent to the atmosphere surrounding heating and pressurization system 10 such that when heated coolant circulates through the tank, any air trapped within the coolant will be released and vented to the atmosphere as the coolant expands. Preferably coolant tank 18 is vented by using a vented cap to cover tank inlet 26.

Coolant pump 20 is attached to coolant tank 18 by manifold 23 such that coolant can flow between coolant tank 18 and coolant pump 20. Coolant outlet conduit 22 has one end attached to coolant pump 20 such that coolant can flow from pump 20 into coolant outlet conduit 22, and another end which is fitted with a first double dry break quick disconnect coupling 32. Coolant inlet conduit 24 has one end attached to coolant tank 18 such that coolant can flow from coolant inlet conduit 24 into coolant tank 18, and another end which is fitted with a second double dry break quick disconnect coupling 34. Each quick connect dry break coupling 32 and 34 is designed such that it can be detachably fixed to an inlet and/or outlet of the cooling system of the engine to be preheated. The double dry break quick disconnect couplings described in this application are available from Snap-tite, Inc., including their 28-1 Series and 29 Series. Preferred embodiments of coolant inlet conduit 22 and coolant outlet conduit 24 comprise flexible hoses.

Coolant pump 20 is operable to pump coolant from coolant tank 18, through pump 20, and into coolant outlet conduit 22. When coolant outlet conduit 22 and coolant inlet conduit 24 are attached to an engine's cooling system by quick disconnect couplings 32 and 34, coolant pump 20 will pump coolant through coolant outlet conduit 22, through the engine's cooling system, through coolant inlet conduit 24, and back into coolant tank 18. Coolant pump 20 should not introduce air into the coolant during pumping. A preferred coolant pump 20 uses a large diameter low speed impeller which provides even flow volume of the coolant at an engine's normal operating pressure. Such an impeller will not cause air entrainment in the coolant from cavitation.

Coolant pump 20 also pressurizes the coolant circulation circuit. Pump 20 provides a predefined constant liquid pressure which is predefined by the desired liquid pressure for the cooling system of the engine with which inventive system 10 is used. A preferred embodiment of the inventive system 10 uses a coolant pump 20 which provides a constant pressure of no more than 20 psi.

An immersion heater 36 is incorporated into the coolant circulation circuit to heat coolant circulating through the system. As this heated coolant is pumped through the engine, the engine is uniformly warmed until it ultimately reaches the engine's desired operating temperature. Immersion heater 36 can be incorporated into the coolant circulation circuit at any point where its heat will not damage elements of the system and where the heating element of the immersion heater 36 will remain submerged in coolant through all heating operations, preventing overheating or burnout of the heating element. In the preferred embodiment, immersion heater 36 is positioned in the bottom of the coolant tank 18. Because coolant continuously flows around the immersion heater 36 rather than constantly remaining still near heater 36, the coolant will not overheat and form air bubbles. Immersion heater 36 is preferably controlled by a bulb and capillary thermostat 49 which allows the user to preset the maximum temperature to which heater 36 heats the coolant (i.e. between 160–190 degrees Fahrenheit). In a preferred embodiment, immersion heater 36 has a maximum sheath temperature of between 25–100 watts per square inch of surface area.

Both pump 20 and immersion heater 36 are powered electrically. While the inventive system 10 could incorporate an internal electrical power source, it is preferred that the inventive system 10 utilize an external power source to increase the unit's portability. The preferred embodiment powers the pump 20 and immersion heater 36 using a cord 38 with plug 40 which can access a commercial power supply or a small portable external electric generator (not shown).

Figure 5:
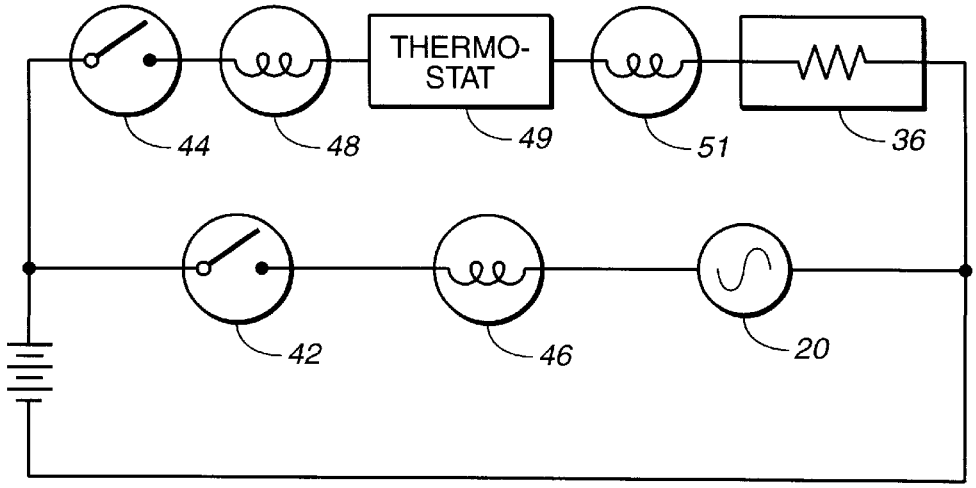
FIG. 5 is an electrical circuit diagram showing the powering of the pump and the immersion heater used in the inventive heating and pressurization system.

Referring to FIG. 5, a circuit showing the preferred electrical circuit powering pump 20 and immersion heater 36 is shown. The power supplied to pump 20 and immersion heater 36 is operable separately using switch 42 to activate or deactivate pump 20, and using switch 44 to activate or deactivate immersion heater 36. For the user's convenience, a pump indicator lamp 46 and heater indicator lamp 48 are provided which are lit when corresponding switch 42 or 44 is closed and the pump 20 or immersion heater circuit is powered. A pilot lamp 51 is lit when the thermostat is closed and the immersion heater 36 is powered. Referring to FIGS. 3 and 4, a pressure sensor 50 determining the pressure in the coolant outlet conduit 22 and a temperature sensor 52 determining the temperature of the coolant in the tank 18 are also provided. Referring to FIG. 1, the user can quickly determine the relevant pressure and temperature at which the inventive system 10 is operating by checking a pressure gauge 54 for pressure sensor 50 and a temperature gauge 56 for temperature sensor 52. Gauges 54 and 56 are preferably commercial analog devices.

Referring to FIGS. 1 and 4, a double dry break quick disconnect coupling 58 is also provided which is fitted to cabinet 12 at an access passage 59 to coolant tank 18. When the coolant pump 20 is running, pressurizing the coolant circulation circuit, quick disconnect dry break coupling 32 can be detachably coupled to quick disconnect dry break coupling 58 to bleed all air from coolant outlet conduit 22 while retaining the coolant flowing between coolant outlet conduit 22 and access passage 59.

Figure 6A:
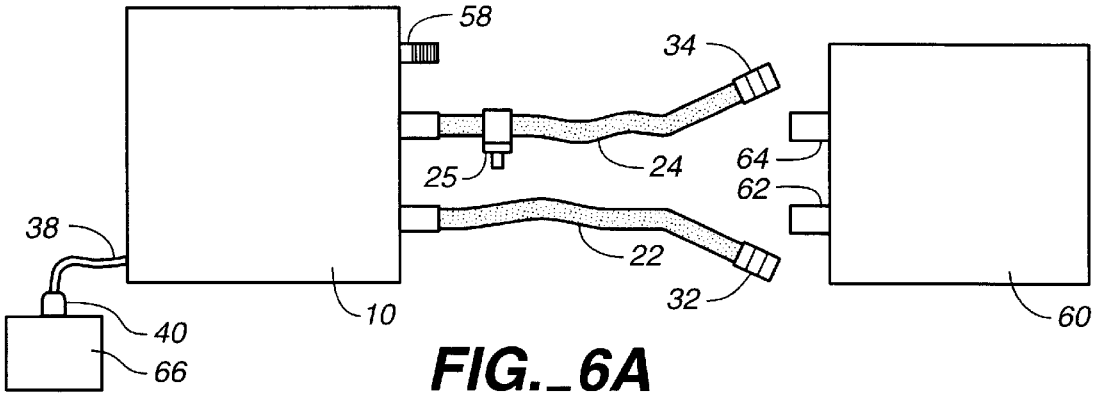
FIGS. 6A, 6B, 6C, 6D, 6E and 6F are all side plan views of the inventive heating and pressurization system in use with a power supply and an engine, and show the process by which the inventive heating and pressurization is used to heat and pressurize the engine.

Referring to FIGS. 6A–6E, the process of using inventive heating and pressurization system 10 with an engine 60 having an inlet 62 and an outlet 64 to its cooling system is shown. Inlet 62 and outlet 64 should be constructed such that quick disconnect couplings 32 and 34 can be connected to them without the introduction of air into or loss of coolant from conduits 22 and 24 or the cooling system of engine 60. Preferably, double dry break quick disconnect couplings are installed at inlet 62 and outlet 64 for this purpose. Referring to FIG. 6A, the inventive system 10 is brought to the location of the internal combustion engine 60 to be heated and pressurized. Inventive system 10 is connected to an external power supply, for example, by inserting plug 40 into a commercial power supply or a portable electric generator 66. Coolant pump 20 is then activated while coolant outlet conduit 22 is disconnected. It is necessary that all connections and disconnections of coolant outlet conduit 22 and coolant inlet conduit 24 by quick disconnect couplings 32 and 34 take place while pump 20 remains activated, because the liquid pressure provided by pump 20 ensures that air will not be introduced into the inventive system 10 or the cooling system of engine 60 during these connections and disconnections. The inventive system 10 uses liquid pressure rather than air pressure to pressurize the engine's cooling system. Even a small amount of air in the engine's cooling system will decrease cooling efficiency and can cause overheating damage to the engine.

Figure 6B:
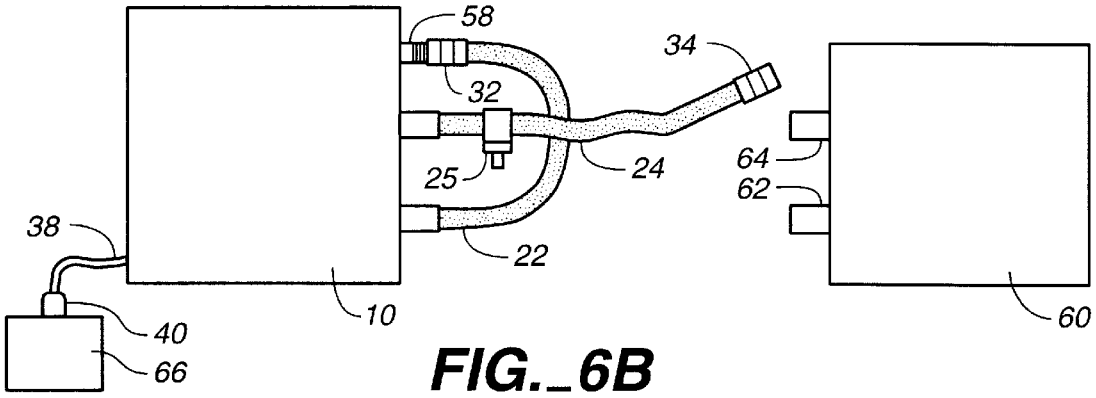

Referring to FIG. 6B, coolant outlet conduit 22 is then connected to quick disconnect coupling 58 by first quick disconnect coupling 32. The pressure provided in coolant outlet conduit 22 by coolant pump 20 pushes any trapped air in coolant outlet conduit 22 through quick disconnect coupling 58 into the tank 18. Any air which enters tank 18 is allowed to vent into the atmosphere. The quick disconnect coupling 32 of coolant outlet conduit 22 is then disconnected from quick disconnect coupling 58, leaving coolant outlet conduit 22 pressurized, filled with coolant, and free of air.

Figure 6C:
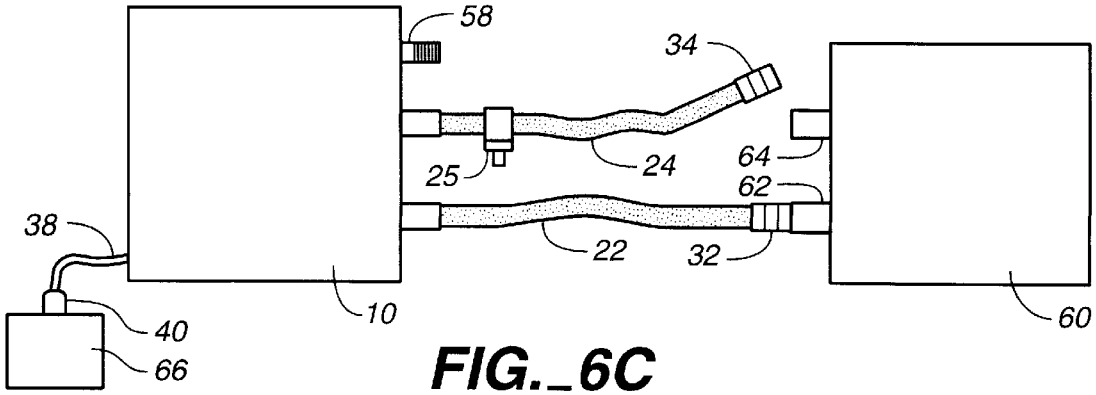
Figure 6D:
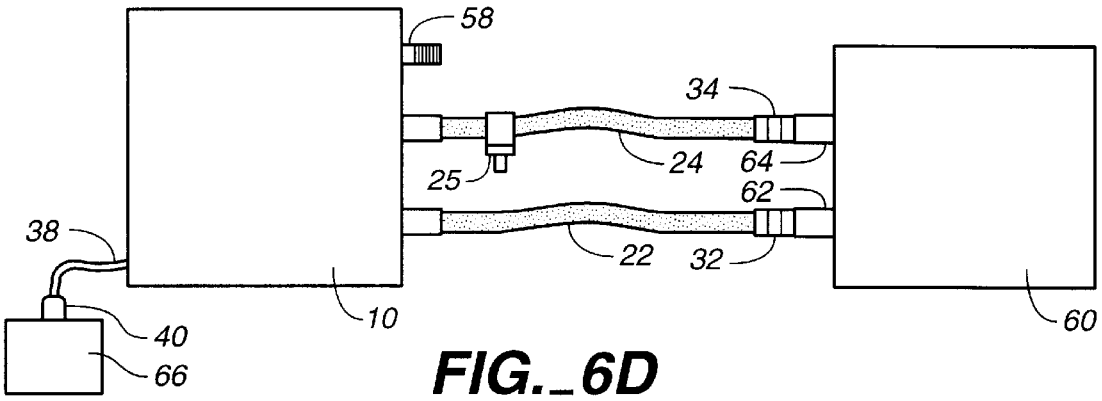

Referring to FIG. 6C, coolant outlet conduit 22 is then attached to inlet 62 of the cooling system of engine 60 by quick disconnect coupling 32. This completes an airless pressurized connection between the inventive heater 10 and the cooling system of engine 60 and pressurizes the cooling system of engine 60 to the pressure provided by pump 20. Referring to FIG. 6D, coolant inlet conduit 24 is then attached to outlet 64 of the cooling system of engine 60, completing the circulation path for the coolant between inventive system 10 and engine 60. Immersion heater 10 is then activated, and pump 20 circulates the heated coolant from coolant tank 18 through coolant outlet conduit 22, into the cooling system of engine 60, through coolant inlet conduit 24, and back into coolant tank 18.

Figure 6E:
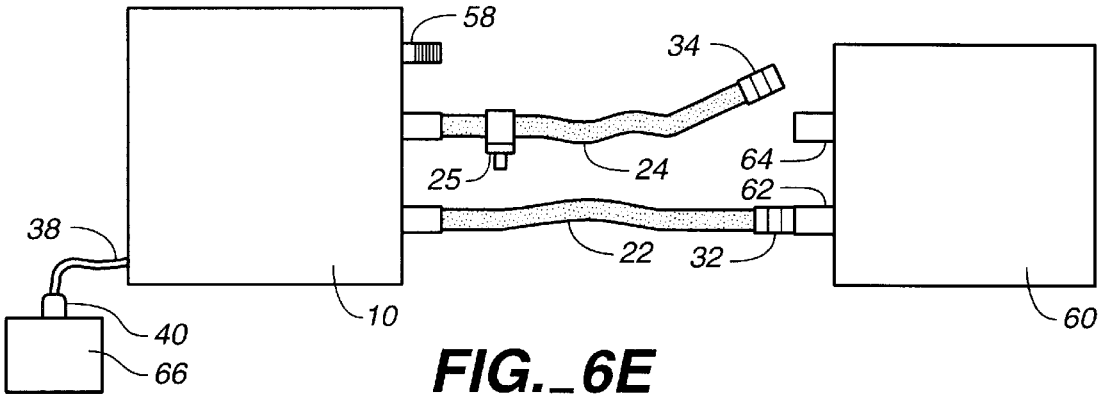
Figure 6F:
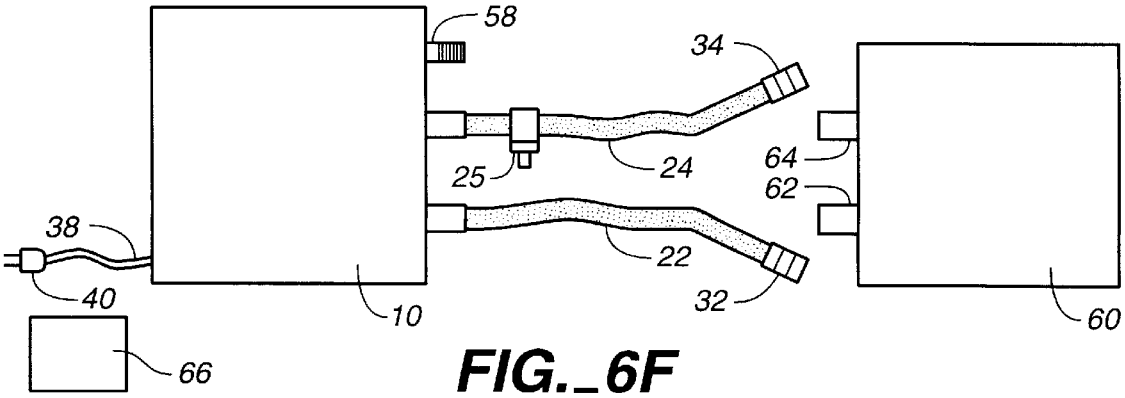

Engine 60 is heated by the passage of heated coolant through its cooling system until engine 60 reaches the desired temperature. The temperature of engine 60 can be independently determined by the user, or system 10 can be operated for a predetermined amount of time after temperature gauge 52 indicates that the coolant has reached the desired temperature. Referring to FIG. 6D, at that point, immersion heater 36 can be deactivated, and second quick disconnect coupling 34 is disconnected from outlet 64, sealing coolant inlet conduit 24 and leaving the cooling system of engine 60 pressurized. Referring to FIG. 6E, first quick disconnect coupling 32 is then disconnected from inlet 62, sealing coolant outlet conduit 22 and leaving engine 60 heated and its cooling system sealed and pressurized. Pump 20 can then be deactivated, and system 10 can be disconnected from power source 66.

The inventive heating and pressurization system 10 may be used to heat any liquid-cooled internal combustion engine, including but not limited to car engines, boat engines, and generally all racing engines. Inventive system 10 can be used to heat an engine undergoing construction as soon as the engine's cooling system is completed, so that the engine can be heated to operating temperature during construction. This gives the engine builder the ability to determine the actual clearances between the engine's components at operating temperature during construction so that the clearances can be accurately minimized.

Although the foregoing invention has been described in some detail by way of illustration for purposes of clarity of understanding, it will be readily apparent to those of ordinary skill in the art in light of the teachings of this invention that certain changes and modifications may be made thereto without departing from the spirit or scope of the appended claims.

It is claimed:

1. A heating and pressurization system for a liquid-cooled engine having a cooling system, comprising:

a coolant circulation circuit comprising a coolant tank, a coolant pump receiving coolant from said coolant tank through a manifold, a coolant outlet conduit having two ends, one of said ends of said coolant outlet conduit attached to said coolant pump and the other of said ends of said coolant outlet conduit having a first double dry break quick disconnect coupling which is detachably fixable to an inlet of said cooling system of said engine, and a coolant inlet conduit having two ends, one of said ends of said coolant inlet conduit attached to said coolant tank and the other of said ends of said coolant inlet conduit having a second double dry break quick disconnect coupling which is detachably fixable to an outlet of said cooling system of said engine;

an immersion heater incorporated into said coolant circulation circuit and operable to heat coolant circulating therein; and a third double dry break quick disconnect coupling connected to said coolant tank by an access passage, said first and said second quick connect dry break couplings detachably fixable to said third double dry break quick disconnect coupling;

said coolant pump operable to circulate coolant at a constant pressure through said coolant circulation system and said cooling system of said engine when said coolant outlet conduit is detachably fixed to said inlet of said cooling system of said engine and said coolant inlet conduit is detachably fixed to said outlet of said cooling system of said engine.

2. The heating and pressurization system of claim 1 wherein said immersion heater receives coolant from said coolant tank and delivers coolant to said coolant pump.

3. The heating and pressurization system of claim 2 wherein said coolant pump and said immersion heater are independently operable, said coolant pump activated and deactivated using a pump switch and said immersion heater activated and deactivated using a heater switch.

4. The heating and pressurization system of claim 3 wherein said coolant tank is vented.

5. The heating and pressurization system of claim 4 further comprising a coolant level gauge indicating the level of coolant in said coolant tank.

6. The heating and pressurization system of claim 5 wherein said coolant pump comprises a large diameter low speed impeller.

7. The heating and pressurization system of claim 6 wherein said coolant pump provides a constant liquid pressure of no more than 20 psi during operation.

8. The heating and pressurization system of claim 7 wherein said coolant outlet conduit and said coolant inlet conduit each comprises a flexible hose.

9. The heating and pressurization system of claim 8 wherein said immersion heater has a maximum sheath temperature of between 25 and 100 watts per square inch of surface area.

10. The heating and pressurization system of claim 9 further comprising a pressure gauge indicating the liquid pressure in said coolant outlet conduit.

11. The heating and pressurization system of claim 10 further comprising a temperature gauge indicating the temperature of coolant circulating through said circulation and pressurization system.

12. A method for using a heating and pressurization system to heat an engine having a cooling system, said engine cooling system having an inlet and an outlet, said heating and pressurization system having a coolant pump which can be activated and deactivated, a coolant outlet conduit to which a first double dry break quick disconnect coupling is attached, a coolant inlet conduit to which a second double dry break quick disconnect coupling is attached, a third double dry break quick disconnect coupling fitted to an access passage to said coolant tank, and an immersion heater which can be activated and deactivated, comprising the steps of:

activating said coolant pump;

fixing detachably said first double dry break quick disconnect coupling to said third double dry break quick disconnect coupling to bleed air from said coolant outlet conduit;

detaching said first double dry break quick disconnect coupling from said third double dry break quick disconnect coupling;

attaching said first double dry break quick disconnect coupling to said inlet of said cooling system of said engine;

attaching said second double dry break quick disconnect coupling to said outlet of said cooling system of said engine;

activating said immersion heater;

maintaining said heating and pressurization system until said engine is heated to a desired temperature;

detaching said second double dry break quick disconnect coupling from said outlet of said cooling system of said engine; and detaching said first double dry break quick disconnect coupling from said inlet of said cooling system of said engine.

* * * * *